US006916280B2

(12) United States Patent
Tönnigs et al.

(10) Patent No.: US 6,916,280 B2
(45) Date of Patent: Jul. 12, 2005

(54) APPARATUS FOR FOLDING CARDBOARD ARTICLES

(75) Inventors: Bodo Tönnigs, Lichtenberg (DE); Lutz Uhlemann, Colmnitz (DE)

(73) Assignee: Ligmatech Automationssysteme GmbH (DE)

( * ) Notice: Subject to any disclaimer, the term of this patent is extended or adjusted under 35 U.S.C. 154(b) by 0 days.

(21) Appl. No.: 10/786,099

(22) Filed: Feb. 26, 2004

(65) Prior Publication Data

US 2004/0180772 A1 Sep. 16, 2004

Related U.S. Application Data

(62) Division of application No. 10/263,562, filed on Oct. 4, 2002.

(30) Foreign Application Priority Data

Oct. 5, 2001 (DE) ..... 101 49 053

(51) Int. Cl.[7] ..... B31F 1/10

(52) U.S. Cl. ..... 493/424; 493/183; 493/356; 493/397; 493/399

(58) Field of Search ..... 493/424, 183, 493/125, 156, 245, 260, 356, 397, 399, 453, 454

(56) References Cited

U.S. PATENT DOCUMENTS 3,695,151 A * 10/1972 Caron ..... 493/181
3,716,962 A * 2/1973 Langen et al. ..... 53/209
3,977,306 A * 8/1976 Flynn ..... 493/31
4,211,356 A 7/1980 Tsuchiya et al. ..... 206/586
5,106,359 A * 4/1992 Lott ..... 493/125
5,393,291 A * 2/1995 Wingerter ..... 493/116
5,531,852 A * 7/1996 Walsh et al. ..... 156/227
5,853,360 A * 12/1998 Jeffrey et al. ..... 493/178
6,226,965 B1 * 5/2001 Lam ..... 53/491
6,569,073 B1 * 5/2003 Bridges et al. ..... 493/183
6,622,461 B2 * 9/2003 Gambetti ..... 53/491

* cited by examiner

*Primary Examiner*—Sameh H. Tawfik
(74) *Attorney, Agent, or Firm*—Finnegan, Henderson, Farabow, Garrett & Dunner, L.L.P.

(57) ABSTRACT

To simplify and speed up folding of plate-like elements (1) along a fold line (2), more particularly in a continuous operation, a method and a an apparatus for folding plate-like elements (1) are proposed which eliminate the use of counter-impression elements in the region of the fold line (2). The apparatus includes a second impression device (6) that folds a second section (4) of the plate-like element (1) about the fold line (2) by a first force component oriented perpendicular to the plane of the second section (4). At the same time the second impression device (6) produces a second force component oriented in the plane of the second section (4) and acting in the direction of the fold line (2) to urge a first section (3) of the plate-like element (1) against a first impression device (5).

9 Claims, 3 Drawing Sheets a)

b)

c)

APPARATUS FOR FOLDING CARDBOARD ARTICLES

This Application is Div. of Ser. No. 10/263,562 filed on Oct. 4, 2002.

TECHNICAL FIELD

The present invention relates to a method of folding plate-like elements, more particularly cardboard articles. In addition, the present invention relates to a device for implementing the method of folding plate-like elements.

PRIOR ART

Plate-like elements, such as cardboard articles for instance, have manifold applications, such as, for example, the packaging of items. During packaging the cardboard articles need to be folded as a rule so as to enclose the item being packaged with the cardboard articles.

Known from prior art are methods for folding cardboard articles as are the corresponding devices in which juxtaposed cardboard sections are folded along a fold line, with fixed or movable counter-impression elements being in contact along the fold line and at least one cardboard section being folded about the axis of the fold line.

These known methods and devices for folding cardboard articles firstly have the disadvantage that the counter-impression elements are still located in the interior of the folded element after folding and thus need to be removed therefrom. In addition, the element to be folded and/or the counter-impression elements need to be travelled and controlled such that they come into contact with each other during folding, which adds to the complexity of the method and the device for folding.

More particularly, where a great many folding actions need to be implemented in sequence, this is often done in a continuous operation i.e., the items to be folded are guided one after the other during folding operations through the folding device.

However, when working in a continuous operation the arrangement of counter-impression elements is a particular disadvantage since the aforementioned disadvantages of the prior art become all the more obvious and the smooth thru-put of the elements to be folded is obstructed by the counter-impression elements.

SUMMARY OF THE INVENTION

The present invention is based on the technical problem of providing a method for folding plate-like elements, more particularly cardboard articles, which eliminates the cited disadvantages of prior art, especially in a continuous operation, and which is simple to implement. In addition, a device is to be provided for folding plate-like elements, more particularly cardboard articles, which configures the method in an advantageous manner.

More particularly, where a great many folding actions need to be implemented in sequence, this is often done in a continuous operation i.e., the items to be folded are guided one after the other during folding operations through the folding device.

The gist of the present invention is based on compensating the force component for the bending action at the section of the plate-like element to be folded by the vertical component of the contact force between the second impression device and plate-like element instead of by separate, complicated counter-impression elements. In other words, due to the improved force engagement of the second impression device on the plate-like element, the present invention does away with the counter-impression elements along the fold line as needed in prior art.

More particularly, the advantages attained with the invention are that, due to eliminating counter-impression elements, smooth sequencing in folding is now possible with a simplified design and control of the folding device. Thus, there is no longer any need to bring counter-impression element and fold line together and no counter-impression element is enclosed by folding. These improvements prove to be of particular advantage when folding in a continuous operation since the plate-like elements are now able to pass through the folding device unobstructed by counter-impression elements.

To facilitate folding, in accordance with a first aspect of the present invention, the fold line of the plate-like elements is preferably produced as a cross-sectional taper and/or perforation. This pre-defines the desired location of the fold line and the force needed for folding is substantially reduced.

It is more particularly of advantage when a large number of folding actions are needed in sequence to implement folding in a continuous operation in accordance with a further aspect of the present invention. In this arrangement, the plate-like elements to be folded are inserted one after the other into the folding device and passed therethrough for folding. This results in a non-stop folding performance, saving time and money.

To reduce the complexities in controlling the folding method and in the design of the folding device, the second impression device in accordance with another aspect of the invention assumes during folding a stationary position along which the second section of the plate-like elements is guided. In this aspect, folding the plate-like element is achieved not by a movement of the second impression device but by the movement of the plate-like element. Proceeding in this way is particularly of advantage when folding in a continuous operation since continuous movement of the plate-like element through the folding device is then simultaneously exploited to execute the folding action.

To produce the second force component in the plane of the second section of the plate-like element, it is of advantage in accordance with a further aspect of the present invention, to exploit the contact forces as a result of the sliding or stick friction between the second impression device and the second section of the plate-like elements. This eliminates the need for special devices, such as for example positive contact elements between the second section of the plate-like element and the second impression device. However, it may also be conducive that the plate-like element is held during folding by the first and/or second impression device, for example non-positively or positively.

To facilitate the continuous operation of the plate-like elements in the continuous operation, the second impression device comprises in accordance with another aspect of the present invention at least one roller which contacts during folding the second section of the plate-like element. It is particularly of advantage in this arrangement when a train of rollers in the second impression device which contact the second section of the plate-like element are clustered into one or more sets of rollers. The rollers or sets thereof guide the plate-like element in the continuous operation through the folding device whilst being arranged so that the second section of the plate-like element is folded by the rollers or sets thereof.

So that the force of the rollers engages the second section of the plate-like element in accordance with the invention, it is the orientation of the rollers or sets thereof relative to the plate-like element that is the deciding factor. In accordance with yet another aspect of the present invention, the axes of the rollers are oriented during folding substantially parallel to the second section of the plate-like element in contact with the roller. At the same time, the axes of the rollers are not at right angles towards the fold line, i.e. the rollers are oriented slanting to the direction of the continuous operation. Slanting the rollers results in them not just running along the second section of the plate-like element but in a frictional force being produced between the rollers and the second section which in accordance with the invention generates a second force component oriented in the plane of the second section and acting in the direction of the fold line. It is in this way that the first section of the plate-like element is urged against the first impression device.

In still another aspect of the invention, the intensity of the frictional force between the rollers and the second section of the plate-like elements can be controlled not only via the arrangement of the rollers but also via the design of the contact surfaces having a specific friction coefficient. In this arrangement, high friction coefficients are preferred for the contact surfaces which may be made of rubber, for example, to ensure adequate contact pressure of the plate-like element with the first impression device.

To permit adapting orientation of the rollers or sets thereof to the marginal conditions of the folding action, for example to the geometry of the plate-like element or the desired folding angle, the rollers can be swivelled about the fold line and/or rotated about an axis perpendicular to the second section. This achieves enhanced flexibility of the folding device.

It is furthermore of advantage in a last aspect of the present invention to facilitate movement of the plate-like elements in a continuous operation through folding device that the first impression device likewise comprises at least one roller which is in contact with the first section during folding.

BRIEF DESCRIPTION OF THE DRAWINGS

The present invention will now be detained with reference to the attached drawings, in which.

DETAILED DESCRIPTION OF AN EXAMPLE EMBODIMENT OF THE INVENTION

Figure 1:
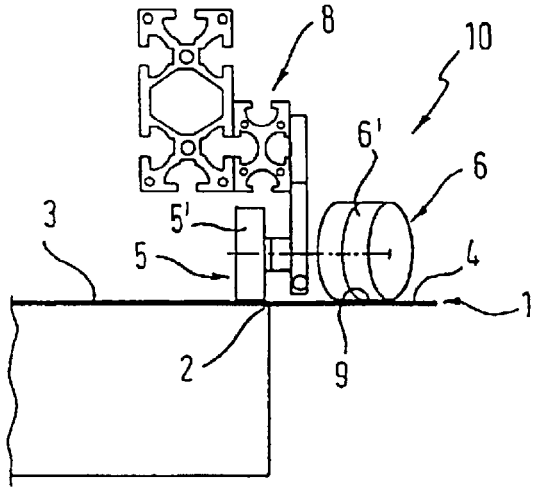
FIG. 1*a* is a diagrammatic view of a folding device in accordance with the invention showing a plate-like element prior to commencement of folding.
FIG. 1*b* is a diagrammatic view of a folding device in accordance with the invention showing a plate-like element during folding.
FIG. 1*c* is a diagrammatic view of a folding device in accordance with the invention showing a plate-like element on conclusion of folding.
Figure 1:
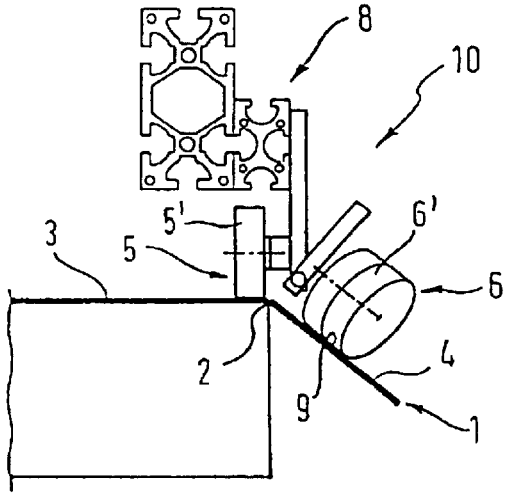
Figure 1:
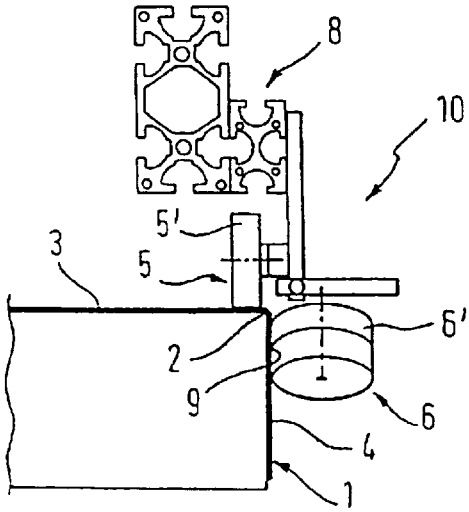
Figure 2:
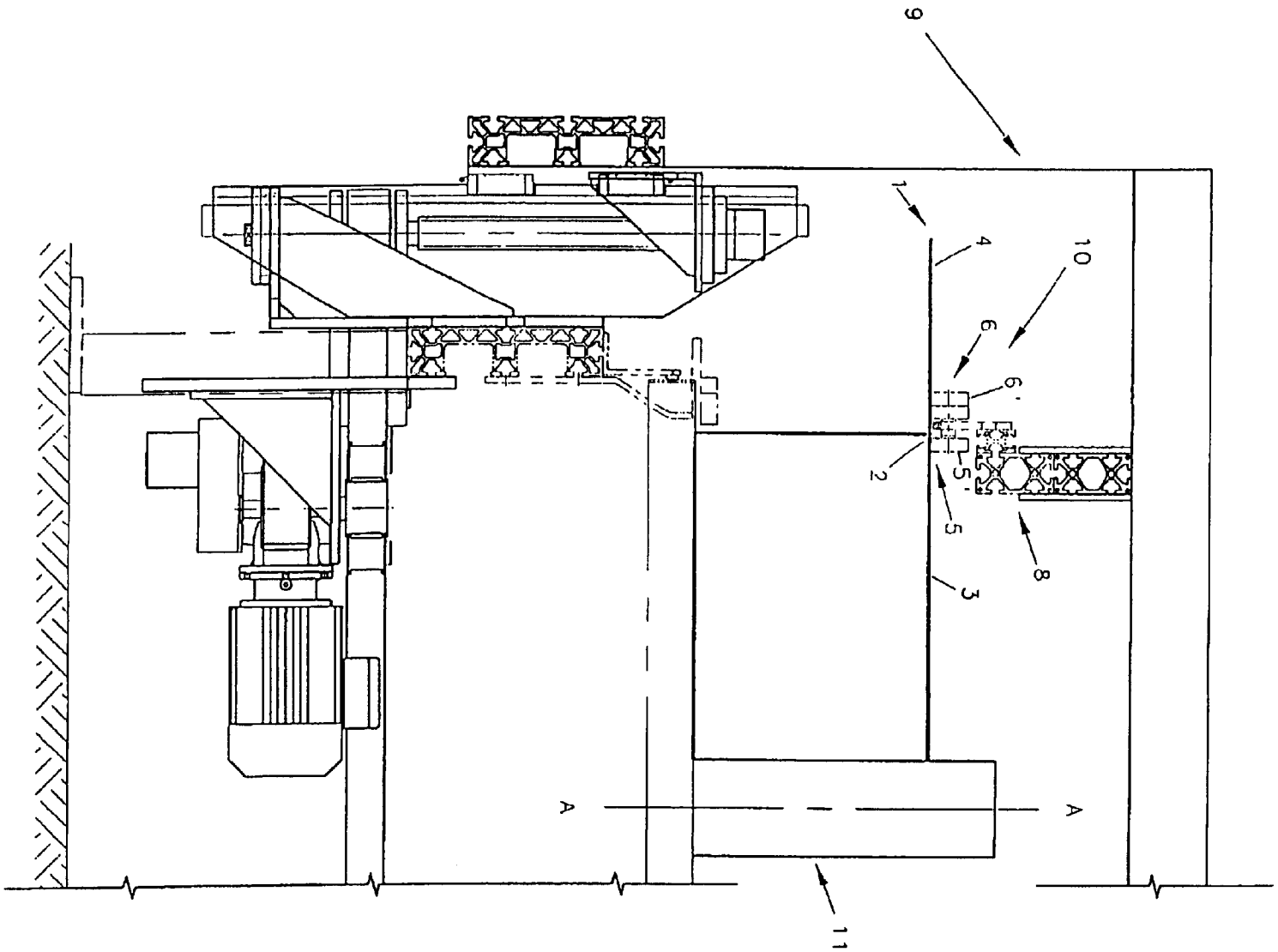
FIG. 2 is a diagrammatic view of a folding device in accordance with the invention as part of a system for conveying and controlling the plate-like element in a continuous operation during folding.

Referring now to FIGS. 1 and 2 there is illustrated diagrammatically a folding device 10 in accordance with the invention for folding a plate-like element 1. The plate-like element 1 may be, for example, a cardboard article (blank). The plate-like element 1 has a first section 3, a second section 4 as well as a fold line 2 located between the first section 3 and second section 4 of the plate-like element 1. The fold line 2 comprises a cross-sectional taper to predefine the location of the fold line 2 and to facilitate folding the plate-like element 1 along the fold line 2.

As shown in FIG. 1 the folding device 10 includes a first impression device 5 contacting the first section 3 of the plate-like element 1, and a second impression device 6 contacting the second section 4 of the plate-like element 1. The first and second impression devices 5, 6 are mounted in common on a mounting device 8 which assumes a stationary position during folding. Both impression devices include rollers 5', 6' which contact by their contact surfaces 9 the first section 3 and second section 4 respectively of the plate-like element 1. The contact surfaces 9 of the rollers feature a high friction coefficient by, for instance, being made of rubber.

The rollers 6' of the second impression device 6 can be swivelled about the fold line 2 and rotated about an axis perpendicular to the second plate-like element 4. In the embodiment as shown in FIG. 1, the axes of the rollers 6' are oriented such that they run substantially parallel to the second section 4 and assume no right angle relative to the fold line 2 in folding.

Figure 3:
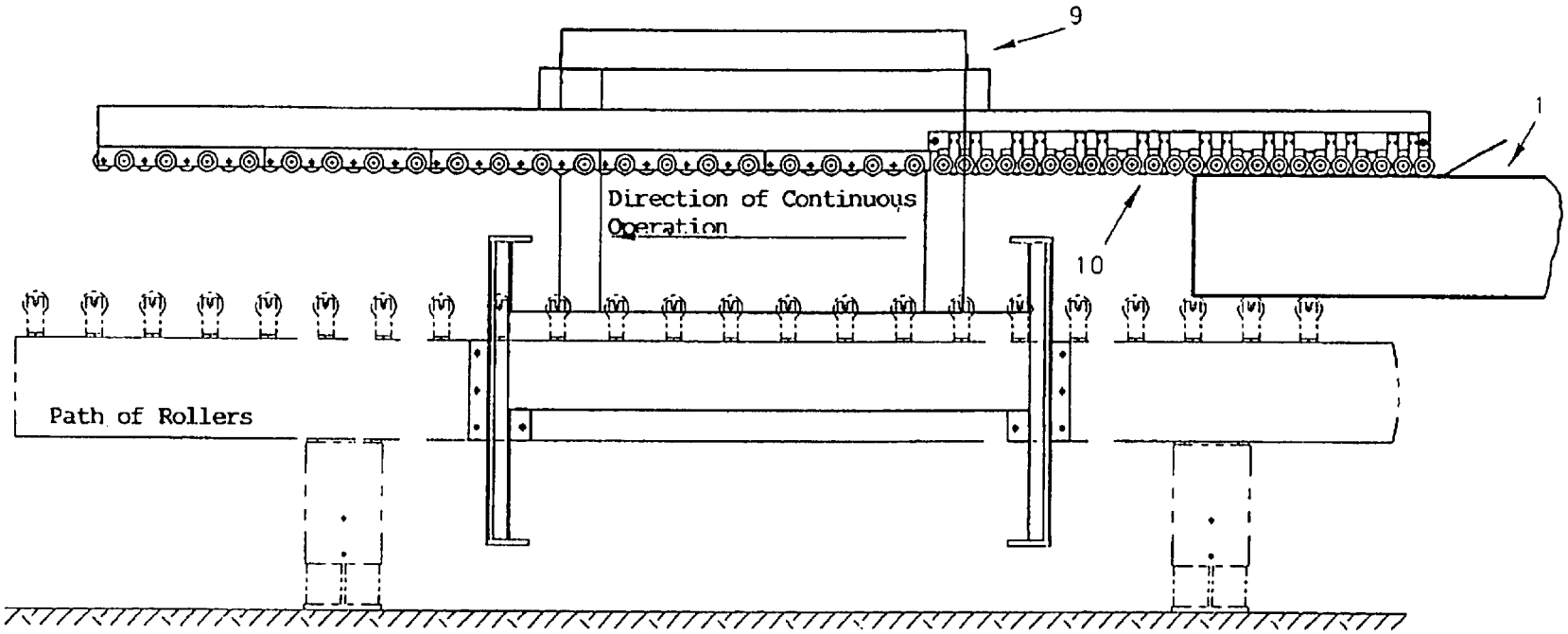
FIG. 3 is a diagrammatic side view of a folding device in accordance with the invention as part of a system for conveying and controlling the plate-like element in a continuous operation during folding.

Referring now to FIGS. 2 and 3, there is illustrated how the folding device 10 is mounted via the mounting device 8 on a system 9 for conveying and controlling the plate-like element 1 in a continuous operation during folding. A train of folding devices 10 is arranged along the system 9 in the direction of the continuous operation. In this arrangement the axes of the rollers 6' of the various folding devices 10 feature diverse swivelling angles about the fold line 2 as well as diverse slant angles relative to the fold line 2.

For enhanced guidance of the plate-like element 1 the continuous-operation system 9 as shown in FIG. 2 comprises a lateral conveyor belt 11 contacting the plate-like element 1 at the side opposite the second section 4. It is also possible that the continuous-operation system 9 together with the folding device 10 and the plate-like element 1 is configured symmetrical to the axis A—A as indicated in FIG. 2. This enables two second sections 4 of the plate-like element 1 to be folded simultaneously whilst a conveyor belt 11 is no longer necessary.

The procedure for folding the plate-like element 1 in a continuous operation along the fold line 2 with the aid of the folding device 10 will now be explained in detail. In this arrangement the direction of the continuous operation as shown in FIGS. 1*a* to 1*c* is perpendicular to the plane of the drawing.

The plate-like element 1 is inserted in the continuous-operation system 9 such that the first and second impression device 5, 6 respectively contacts the first and second sections of the plate-like element 1 of the folding device 10 arranged at the zero edge. The system 9 conveys the plate-like element 1 in the direction of the continuous operation. The first and second sections 3, 4 slide along the first and second impression device 5, 6 of the folding device 10 in sequence in the direction of the continuous operation.

During the continuous conveyance of the plate-like element 1, a second impression device 6 in each case sweeps the second section 4 of the plate-like element 1 about the fold line 2. At the same time, due to the slant of the rollers 6', a frictional force materializes between the second impression device 6 and second section 4 which produces a second force component in the plane of the second section 4 in the direction of the fold line 2, resulting in the first section 3 of the plate-like element 1 being pressed against the first impression device 5.

Every time the plate-like element 1 passes along a second impression device 6 of a folding device 10 the second section 4 is folded by a specific angle, the extent of which depends on the swivelling and slanting angle of the rollers 6' of each second impression device 6. In this way the plate-like element 1 is folded in a continuous operation by a train of folding devices 10 until the desired fold angle is attained.

What is claimed is:

1. Apparatus for continuously folding a flat plate element along a fold line, said flat plate element having a first section adjacent to and on one side of the fold line and a second section adjacent to and on the opposite side of the fold line, the apparatus comprising means for continuously moving the element in a direction essentially parallel to the fold line thereof, a first impression device and a second impression device, said means for continuously moving the element, moving the element past the devices so that the first section of the element contacts and slides along the first impression device and the second section of the element contacts and slides along the second impression device, the second impression device folding the second section of the element about the fold line during such movement, said second impression device during said folding creating a first force component that acts in a direction perpendicular to the plane of the second section of the element and a second force component extending in the plane of the second section of the element that acts in a direction towards the fold line to press the first section of the element against the first impression device.

2. The apparatus of claim 1, wherein the second force component extending in the plane of the second section and acting in the direction towards the fold line is a frictional force between the second impression device and the second section.

3. The apparatus of claim 1, wherein during folding of the element, the second impression device assumes a stationary position relative to the movement of the element along which the second section of the element slides.

4. The apparatus of claim 1, wherein the second impression device has at least one roller which contacts the second section during folding.

5. The apparatus of claim 4, wherein the second impression device comprises a set of rollers with rollers arranged in a train in the direction of movement of the element, which set of rollers contact the second section during folding.

6. The apparatus of claim 5, wherein the axes of the rollers of the second impression device are substantially parallel to the second section during folding.

7. The apparatus of claim 5, wherein the rollers of the second impression device can be swiveled about the fold line and/or rotated about an axis perpendicular to the second section of the element.

8.The apparatus of claim 4, wherein the at least one roller has a contact surface having a high friction coefficient.

9. The apparatus of claim 1 or 4, wherein the first impression device has at least one roller which contacts the first section during folding.

* * * * *